US006047912A

United States Patent [19]

Smith

[11] Patent Number: 6,047,912

[45] Date of Patent: Apr. 11, 2000

[54] BREAK-AWAY PROCESSING TOOL FOR A WASTE PROCESSING MACHINE

[76] Inventor: Leward N. Smith, Rte. 4, Box 160, Lake City, Fla. 32024

[21] Appl. No.: 09/071,238

[22] Filed: May 1, 1998

[51] Int. Cl.[7] ..... B02C 13/02; B02C 13/28

[52] U.S. Cl. ..... 241/32; 241/37.5; 241/191; 241/195; 241/291; 241/300

[58] Field of Search ..... 241/32, 191, 194, 241/195, 197, 291, 300, 292.1, 37.5

[56] References Cited

U.S. PATENT DOCUMENTS

| | | | |
|---|---|---|---|
| 190,675 | 5/1877 | Gaines | 241/294 |
| 589,236 | 8/1897 | Williams | 241/194 |
| 604,283 | 5/1898 | Albrecht | 241/194 |
| 787,290 | 4/1905 | Griffin | 241/32 |
| 1,266,894 | 5/1918 | Williams | 241/195 |
| 1,559,924 | 11/1925 | Willcox | 241/32 |
| 1,713,507 | 5/1929 | Ammon | 241/194 |
| 1,752,290 | 4/1930 | Ammon | 241/194 |
| 1,761,083 | 6/1930 | Liggett | 241/32 |
| 1,889,129 | 11/1932 | Nielsen | 241/195 |
| 2,026,790 | 1/1936 | Mankoff | 83/11 |
| 2,128,194 | 8/1938 | Sheldon et al. | 83/11 |
| 2,244,577 | 6/1941 | Schreiber | 83/11 |
| 2,318,219 | 5/1943 | Harris | 83/11 |
| 2,392,958 | 1/1946 | Tice | 241/55 |
| 2,663,505 | 12/1953 | Sennholtz | 241/197 |
| 2,705,596 | 4/1955 | Poyser | 241/32 |
| 2,710,635 | 6/1955 | Alexander | 144/162 |
| 2,863,476 | 12/1958 | Clark | 144/172 |
| 2,864,420 | 12/1958 | Schmidt | 146/106 |

(List continued on next page.)

OTHER PUBLICATIONS

Wood Waste Disposal Problems: Bandit Has Some Answers!, Bandit Industries, Inc. Hard Hat News, Oct. 22, 1993.

The Beast, Model 30 Grinding Yard Waste, Model 15, Grinding Housing Demolition, Waste Handling Equipment News, Sep. 1994.

Bandit's Beast Maintains Nature's Beauty, Construction Equipment Guide, Jun. 1, 1994.

Bandit Industries, Inc., Reader Card 218, Forest Publications, Timber West, Nov. 1993.

Bandit Industries' Model 15–H Beast Recycler, Forest Products Equipment, Aug. 1994.

The Model 15 Beast, Bandit Industries, Inc., MSW Management, Mar./Apr. 1994.

Want to Lower the Cost of Breaking Down Yard and Other Landfill Waste? . . . Try the Beast from Bandit, Resource Recycling, Nov. 1994.

Turn Your Green Waste Into Green Dollars, Bandit Industries, Inc., Sportsturf, 1994.

"Product Release" for the new Model 15–H Beast Recycler Offered by Bandit Industries, Waste Handling Equipment New, Jun. 1994.

For Your Chipping and Grinding Needs, Bandit Industries, Inc., Forest Products Equipment, Aug. 1994.

Megagrind by Rexworks 800, 1995.

How to chop yard waste costs!, 1000 Commercial Grinder, Farmhand.

The Beast, Model 15–H, Bandit Industries, Inc.

The Beast Recyclers from Bandit Industries . . . with Big Appetites for Waste, Bandit Industries.

The Beast—Coming in the Summer of 1993 from Bandit Industries, Inc., Bandit Industries, Inc.

Maxigrind by Rexworks, The Most Versatile Materials Processing Machine.

Industrial Grinder, Big Bite, Manufactured by Haybuster.

*Primary Examiner*—John M. Husar
*Attorney, Agent, or Firm*—Bliss McGlynn, P.C.

[57] ABSTRACT

A break-away processing tool for a waste processing machine includes a tool holder, at least one fastener for attaching the tool holder to a rotor assembly of the waste processing machine and a structure for allowing breakage of the tool holder in a controlled manner such that broken pieces of the tool holder remains attached to the rotor assembly by the fastener.

20 Claims, 5 Drawing Sheets

U.S. PATENT DOCUMENTS

| | | | |
|---|---|---|---|
| 3,194,543 | 7/1965 | McIlavine | 259/107 |
| 3,254,687 | 6/1966 | Tertyshnikov | 146/79 |
| 3,367,585 | 2/1968 | Ratkowski | 241/197 |
| 3,436,028 | 4/1969 | Koehnen et al. | 241/186 |
| 3,509,924 | 5/1970 | Newhouse, Jr. | 146/70.1 |
| 3,642,214 | 2/1972 | Blackwell, Jr. | 241/191 |
| 3,844,494 | 10/1974 | Hightower | 241/197 |
| 3,907,016 | 9/1975 | Nicholson et al. | 144/172 |
| 4,000,859 | 1/1977 | Whitney | 241/194 |
| 4,060,961 | 12/1977 | Anderson | 56/294 |
| 4,074,594 | 2/1978 | Dall et al. | 76/101 |
| 4,076,177 | 2/1978 | Hirayama et al. | 241/32 |
| 4,077,450 | 3/1978 | Ackerman | 144/172 |
| 4,077,573 | 3/1978 | Kersey et al. | 241/32 |
| 4,117,985 | 10/1978 | Lazareck | 241/197 |
| 4,129,260 | 12/1978 | Baker | 241/46 |
| 4,129,262 | 12/1978 | Lowry | 241/197 |
| 4,146,184 | 3/1979 | Whitney | 241/73 |
| 4,146,185 | 3/1979 | Schober | 241/188 R |
| 4,162,769 | 7/1979 | Lapointe | 241/68 |
| 4,162,770 | 7/1979 | Lewis | 241/191 |
| 4,168,035 | 9/1979 | Palm et al. | 241/81 |
| 4,344,581 | 8/1982 | Redemann | 241/88.4 |
| 4,504,019 | 3/1985 | Newell et al. | 241/73 |
| 4,558,826 | 12/1985 | Martinek | 241/189 R |
| 4,573,643 | 3/1986 | Orphall et al. | 241/189 R |
| 4,688,731 | 8/1987 | Hunt et al. | 241/191 |
| 4,702,424 | 10/1987 | Widlak | 241/101.7 |
| 4,717,083 | 1/1988 | Quast et al. | 241/197 |
| 4,848,681 | 7/1989 | Eriksson et al. | 241/183 |
| 4,850,406 | 7/1989 | Krautzberger | 144/230 |
| 4,872,500 | 10/1989 | Duffey et al. | 164/34 |
| 4,915,310 | 4/1990 | Stelk | 241/197 |
| 4,917,314 | 4/1990 | Manschwetus | 241/194 |
| 4,922,977 | 5/1990 | Colton et al. | 144/230 |
| 4,967,969 | 11/1990 | Griffith, III | 241/93 |
| 4,982,904 | 1/1991 | Greiner | 241/73 |
| 5,002,233 | 3/1991 | Williams | 241/189 A |
| 5,042,727 | 8/1991 | Plante | 241/101.7 |
| 5,044,567 | 9/1991 | Hte et al. | 241/73 |
| 5,078,328 | 1/1992 | Willingham | 241/101.7 |
| 5,114,085 | 5/1992 | Inui | 241/195 |
| 5,205,496 | 4/1993 | O'Donnell et al. | 241/34 |
| 5,209,278 | 5/1993 | Carpenter et al. | 144/230 |
| 5,285,974 | 2/1994 | Cesarini | 241/194 |
| 5,372,316 | 12/1994 | Bateman | 241/191 |
| 5,377,919 | 1/1995 | Rogers et al. | 241/189.2 |
| 5,392,999 | 2/1995 | Konig et al. | 241/194 |
| 5,413,286 | 5/1995 | Bateman | 241/190 |
| 5,474,239 | 12/1995 | Williams, Jr. et al. | 241/73 |
| 5,507,441 | 4/1996 | De Boef et al. | 241/73 |
| 5,526,988 | 6/1996 | Rine | 241/23 |
| 5,529,249 | 6/1996 | Braun et al. | 241/32 |
| 5,611,496 | 3/1997 | Fleenor | 241/166 |
| 5,713,525 | 2/1998 | Morey | 241/32 |

BREAK-AWAY PROCESSING TOOL FOR A WASTE PROCESSING MACHINE

BACKGROUND OF THE INVENTION

1. Field of the Invention

The present invention relates generally to waste processing machines and, more particularly, to a break-away processing tool for a waste processing machine.

2. Description of the Related Art

It is known to provide waste processing machines to reduce waste product. The waste processing machine typically includes a rotor assembly having a rotor and a plurality of processing tools attached to the rotor. The processing tool is provided with a cutting tool for reducing the waste product as the rotor rotates.

An example of such a waste processing machine is disclosed in pending patent application, U.S. Ser. No. 08/637,233, filed Apr. 24, 1996, entitled "WASTE PROCESSING MACHINE", now U.S. Pat. No. 5,863,003 the disclosure of which is hereby incorporated by reference. In that application, the processing tool is generally C-shaped wherein a leading arm of the C-shape operates as a depth-limiting guide for the processing tool and a trailing arm of the C-shape includes a cutting tool for reducing the waste product.

Although the above waste processing machine has worked well, it suffers from the disadvantage that a failure or breakage of the processing tool will allow a portion or broken piece of the processing tool to be loose and travel about the rotor, possibly resulting in damage of the rotor and/or the other processing tools of the rotor assembly. Thus, there is a need in the art to provide a waste processing machine with a processing tool that allows for breakage of the processing tool in a controlled manner and prevents the breakage of the processing tool from damaging the rotor assembly.

SUMMARY OF THE INVENTION

It is, therefore, one object of the present invention to provide a break-away processing tool for a waste processing machine.

It is another object of the present invention to provide a break-away processing tool for a waste processing machine that allows breakage of the processing tool in a controlled manner and minimizes damage to a rotor assembly of the waste processing machine caused by the breakage.

It is yet another object of the present invention to provide a break-away processing tool for a waste processing machine that secures broken pieces of the processing tool to the rotor assembly of the waste processing machine.

To achieve the foregoing objects, the present invention is a break-away processing tool for a waste processing machine. The break-away processing tool includes a tool holder, at least one fastener for attaching the tool holder to a rotor assembly of the waste processing machine. The break-away processing tool also includes means for allowing breakage of the tool holder in a controlled manner such that broken pieces of the tool holder remains attached to the rotor assembly by the at least one fastener.

One advantage of the present invention is that a break-away processing tool is provided for a waste processing machine. Another advantage of the present invention is that the break-away processing tool allows for breakage in a controlled manner and broken pieces remains attached to the rotor assembly in the waste processing machine, thereby minimizing possible damage to the rotor and/or the other processing tools of the rotor assembly in the waste processing machine.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
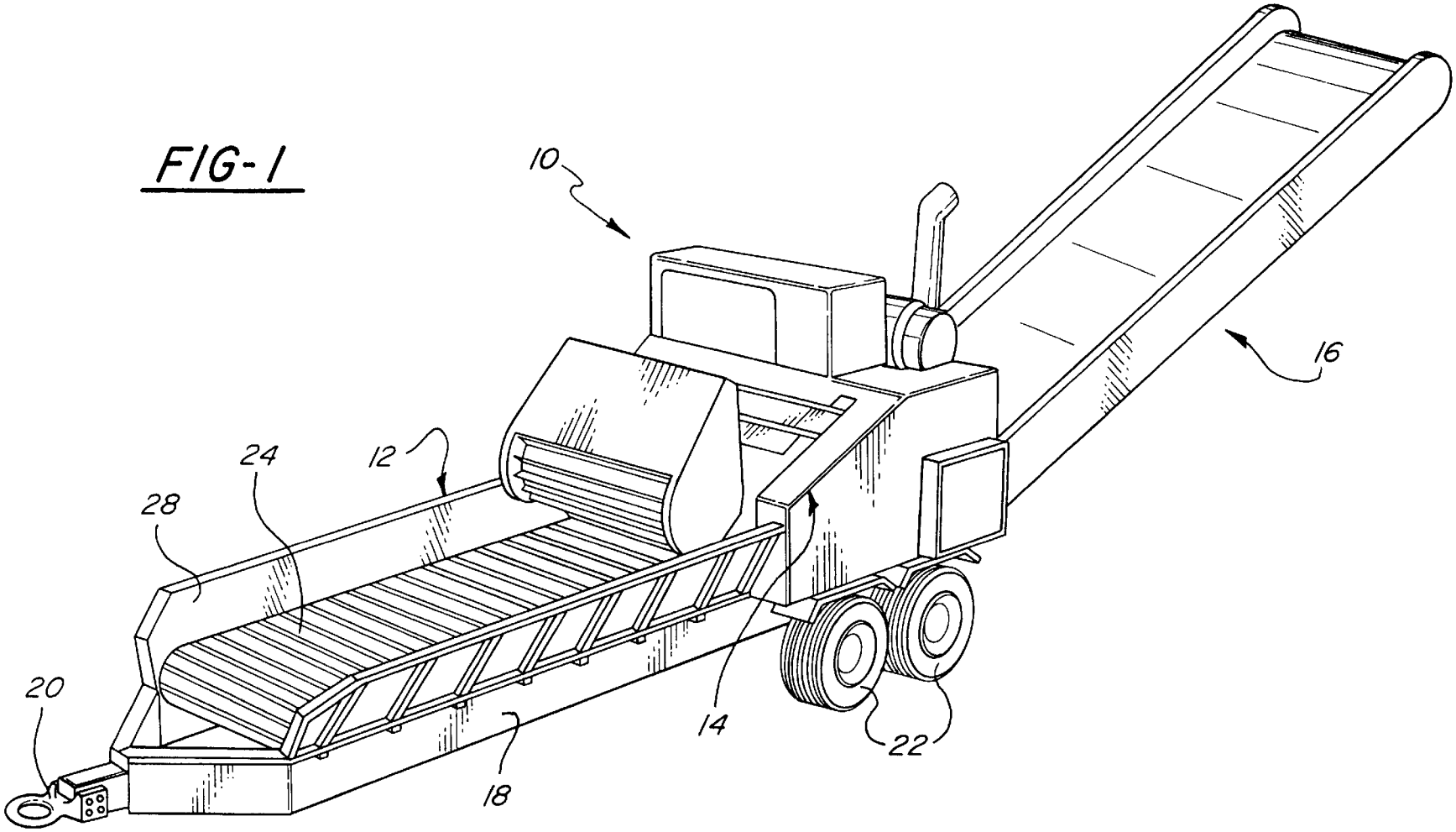
FIG. 1 is a perspective view of a waste processing machine.

Referring now to the drawings and in particular to FIG. 1, one embodiment of a waste processing machine 10 for reducing waste product is shown. The waste processing machine 10 includes an infeed system 12, a waste reducing or cutting system 14, and a discharge system 16. Waste product enters the waste processing machine 10 through the infeed system 12 where it is directed to the cutting system 14. The cutting system 14 cuts or reduces the waste product and directs it to the discharge system 16 where the reduced waste product is expelled from the waste processing machine 10. The waste processing machine 10 may be supported on a trailer framework 18 having a tongue mount 20 provided at a front thereof and wheels 22 near a rear of the framework 18. It should be appreciated that, with this structure, the infeed system 12 and cutting system 14 can be transported together while the discharge system 16 can be transported separately therefrom.

Figure 2:
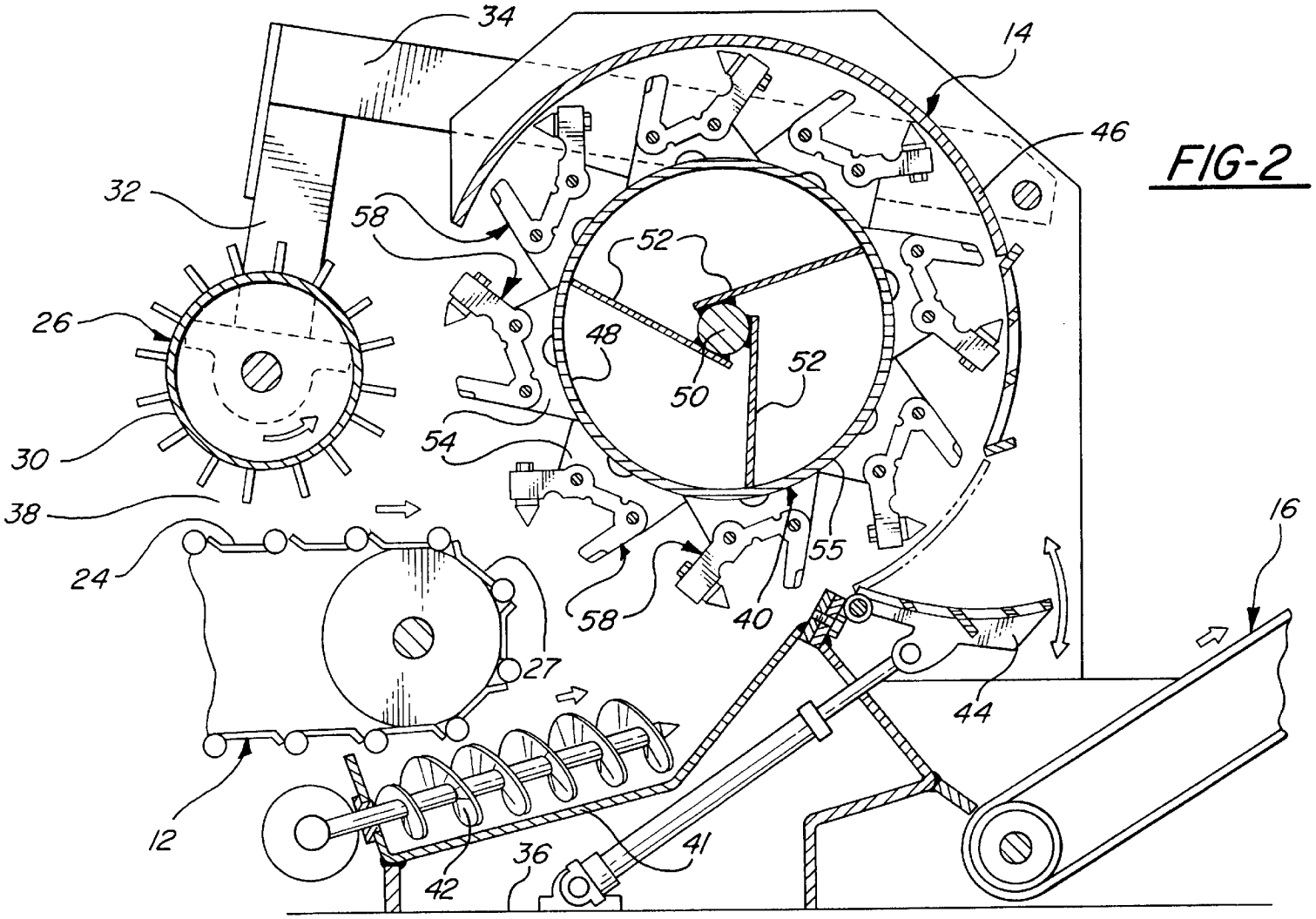
FIG. 2 is a fragmentary elevational view of a break-away processing tool, according to the present invention, illustrated in operational relationship with the waste processing machine of FIG. 1.

Referring to FIGS. 1 and 2, the infeed system 12 includes an infeed conveyor 24 and a feed wheel assembly 26. The infeed conveyor 24 has a terminal end 27 spaced a predetermined distance such as one quarter inches (0.25 inches) from a rotor assembly 40 of the cutting system 14. The infeed conveyor 24 is the sole means of support for the waste product and acts as a primary anvil for reducing the waste product by the rotor assembly 40 to be described. Opposed side walls 28 are provided on opposite sides of the conveyor 24 to contain the waste product.

The feed wheel assembly 26 includes a feed wheel 30 which is rotatably mounted to a lower end of a vertical support arm 32. A conventional hydraulic motor (not shown) is provided to rotate the feed wheel 30. An upper end of the vertical support arm 32 is mounted to one end of a horizontal support arm 34. The other end of the horizontal support arm 34 is pivotally mounted to a support frame 36 for the waste processing machine 10. At least one hydraulic cylinder (not shown) is provided between the vertical support arm 32 and the support frame 36 for altering the position of the feed wheel 30 with respect to the infeed conveyor 24. It should be appreciated that the hydraulic cylinder raises and lowers the feed wheel 30 with respect to the infeed conveyor 24.

In operation, waste product is placed on the infeed conveyor 24 which moves the waste product into contact with the feed wheel 30 which, in turn, rolls the waste product through an inlet opening 38 into contact with the cutting system 14. Preferably, the feed wheel 30 pivots freely with respect to the support frame 36 during operation of the waste processing machine 10 so that as large pieces of waste product are drawn into the inlet opening 38. The feed wheel 30 and support arms 32, 34 will pivot upwardly about a pivot point thereby enlarging the inlet opening 38 to accommodate the waste product. It should be appreciated that, as the large waste product passes through the inlet opening 38 into the cutting system 14, gravity will draw the feed wheel 30 back down toward the infeed conveyor 24.

Figure 3:
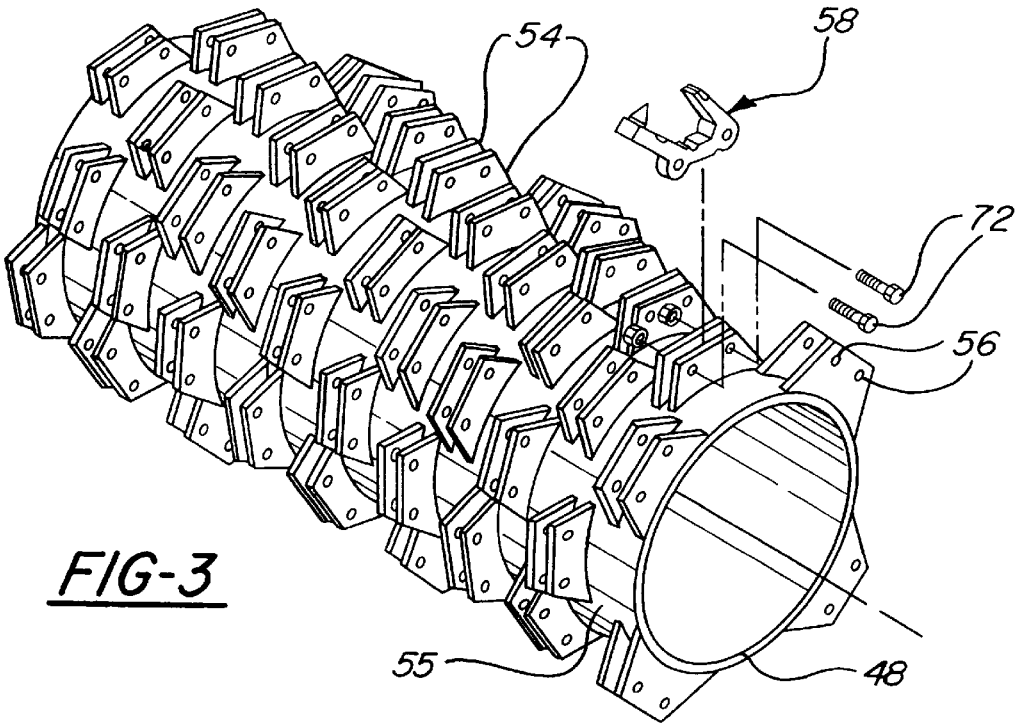
FIG. 3 is an exploded perspective view of the break-away processing tool and rotor assembly of the waste processing machine of FIG. 1.
Figure 4:
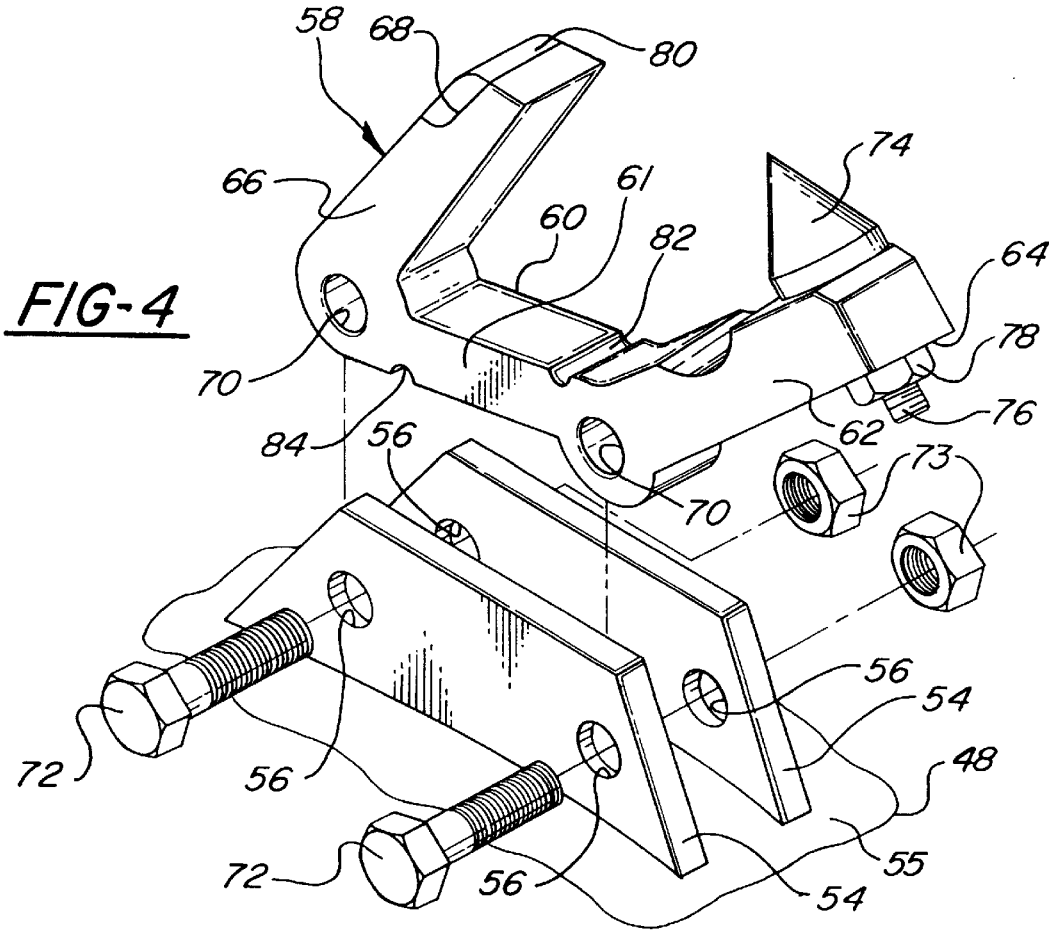
FIG. 4 is an enlarged exploded perspective view of the break-away processing tool and rotor assembly of FIG. 3.

Referring to FIGS. 2 through 4, the cutting system 14 includes a rotor assembly, generally indicated at 40, which is rotatably mounted to the support frame 36. The cutting system 14 also includes a housing 41 disposed about the rotor assembly 40 and a plurality of regrind augers 42 positioned at a bottom of the housing 41. The cutting system 14 further includes a movable concave screen 44 and a fixed concave screen 46. It should be appreciated that the cutting system 14 reduces waste product by the rotor assembly 40 which passes through the screens 44, 46 to the discharge system 16. It should also be appreciated that the regrind augers 42 move reduced waste product into contact with the rotor assembly 40 for further reduction to pass through the screens 44, 46.

Referring to FIGS. 2 and 3, the rotor assembly 40 includes a rotor 48. The rotor 48 is a generally cylindrical tube having a longitudinal axis. The rotor 48 is mounted to a coaxially disposed shaft 50 by multiple braces 52 extending tangentially from an outer surface of the shaft 50 to an inner surface of the rotor 48. Preferably, each brace 52 is an elongated plate-like member fixed tangentially to the shaft 50 by suitable means such as welding and is similarly secured to the inner surface of the rotor 48 by suitable means such as welding. It should be appreciated that a power source (not shown) is connected to the shaft 50 in a well-known manner and is adapted to turn the shaft 50 and rotor 48.

Referring to FIGS. 2 through 4, the rotor assembly 40 also includes a plurality of spaced pairs of mounting arms 54 mounted to an outer surface 55 of the rotor 48 by suitable means such as welding. Each mounting arm 54 is generally trapezoidal in shape and includes at least one, preferably a pair of spaced apertures 56 extending therethrough. The rotor assembly 40 further includes a break-away processing tool, according to the present invention and generally indicated at 58, mounted to each pair of mounting arms 54. Preferably, the pairs of mounting arms 54 are mounted about the rotor 48 so that in one rotation of the rotor assembly 40, every point on an imaginary axial line segment positioned adjacent to the rotor assembly 40 will be contacted by the break-away processing tools 58 mounted to the rotor assembly 40.

The break-away processing tool 58, according to the present invention, includes a tool holder 60 having a general "C" shape. The tool holder 60 has a body 61 extending circumferentially and a first or trailing arm 62 extending radially at an angle therefrom with a first aperture 64 extending therethrough. The tool holder 60 also includes a second or leading arm 66 extending radially at an angle from the body 61 with a recess 68 at one end thereof. The tool holder 60 includes an aperture 70 at a lower radial end of each of the first arm 62 and second arm 66 and extending axially therethrough. The body 61 has a width or thickness less than the first arm 62 and second arm 66. The tool holder 60 is continuous, integral, unitary and made as one-piece. It should be appreciated that the apertures 70 of the tool holder 60 are aligned with the apertures 56 of the mounting arms 54.

The rotor assembly 40 includes a fastener such as a bolt 72 and nut 73 for retaining the break-away processing tool 58 to the mounting arms 54. The bolt 72 extends through the apertures 56 in the mounting arms 54 and the apertures 70 of the tool holder 60. It should be appreciated that the tool holder 60 is disposed between the mounting arms 54.

The break-away processing tool 58 also includes a cutting tool 74 attached to the tool holder 60. The cutting tool 74 is a carbide member having a shaft 76 extending through the aperture 64 in the first arm 62 and removably secured thereto by a nut 78 threadably engaging the shaft 76. The break-away processing tool 58 also has a wear bar 80 disposed in the recess 68 of the second arm 66. The wear bar 80 is a carbide member secured to the second arm 66 by suitable means such as brazing. It should be appreciated that the first arm 62 operates as a depth-limiting guide and the second arm 66 operates as a cutter or reducer to reduce the waste product.

The break-away processing tool 58 includes at least one notch 82 in the tool holder 60 to control breakage of the break-away processing tool 58. Preferably, the break-away processing tool 58 includes a first notch 82 in the body 61 adjacent to the first arm 62 between the first arm 62 and second arm 66 on a radial outer side thereof and a second notch 84 in the body 61 adjacent to the second arm 66 between the first arm 62 and second arm 66 on a radial inner side thereof. The notches 82, 84 extend axially across the body 61 of the tool holder 60. The notches 82, 84 are generally arcuate in shape and have a depth of approximately one quarter inches (0.25 inches). The position, shape and depth of the notches 82, 84 are varied to control breakage of the tool holder 60 relative to either the first arm 62 or second arm 66 of the tool holder 60.

Figure 5:
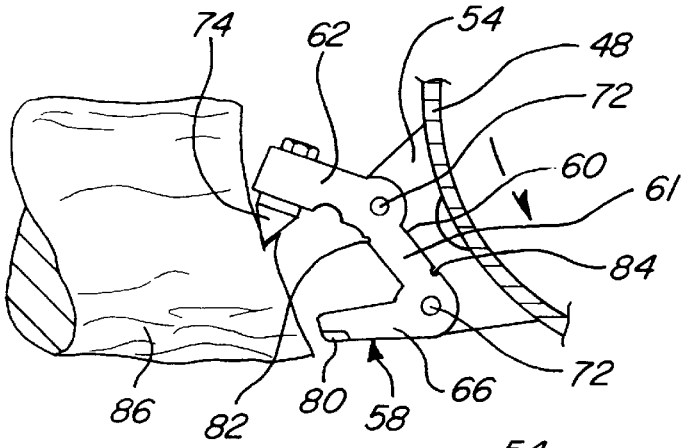
FIG. 5 is a fragmentary elevational view of the break-away processing tool of FIG. 2 in contact with waste product.
Figure 6:
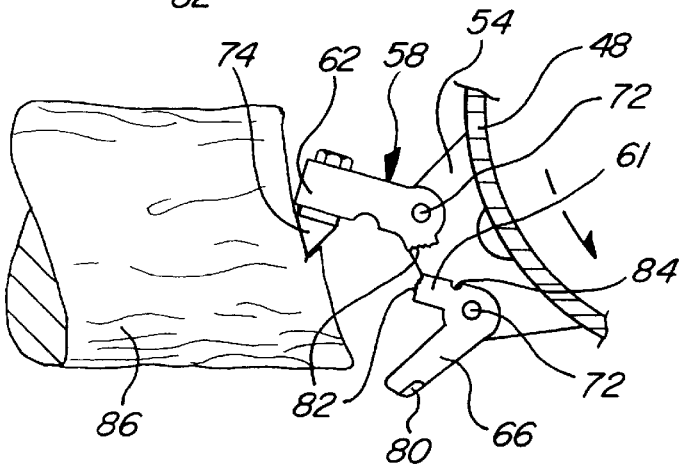
FIG. 6 is a view similar to FIG. 5 illustrating breakage of the break-away processing tool of FIG. 2.

Referring to FIGS. 5 and 6, in operation, the cutting tool 74 contacts waste product 86, such as a wooden log, first approximately three revolutions before the wear bar 80 contacts the waste product 86. If the waste product 86 is stuck or lodged by the cutting tool 74 in the waste processing machine 10, the first arm 62 will concentrate stress on the tool holder 60 in the notch 82 adjacent to the first arm 62 and cause a breakage by propagating a crack from the notch 82 radially across the body 61 of the tool holder 60. As such, the first arm 62 will then pivot about the bolt 72 which acts as a first pivot pin and remain attached to the mounting arms 54 to prevent damage to the rotor assembly 40. Also, the remainder of the tool holder 60 including the body 61 and second arm 66 will pivot about the other bolt 72 which acts as a second pivot pin and remain attached to the mounting arms 54 to prevent damage to the rotor assembly 40. The tool holder 60 can then be replaced.

Similarly, if waste product 86 is stuck or lodged by the wear bar 80 in the waste processing machine 10, the second arm 66 will concentrate stress on the tool holder 60 in the notch 84 adjacent to the second arm 66 and cause a breakage by propagating a crack from the notch 84 radially across the body 61 of the tool holder 60. As such, the second arm 66 will then pivot about the bolt 72 which acts as a second pivot pin and remains attached to the mounting arms 54 to prevent damage to the rotor assembly 40. Also, the remainder of the tool holder 60 including the body 61 and first arm 62 will pivot about the other bolt 72 which acts as a first pivot pin and remain attached to the mounting arms 54 to prevent damage to the rotor assembly 40. The tool holder 60 can then be replaced. It should be appreciated that the body 61 has less mass than the first arm 62 and second arm 66 to ensure failure by the notches 82 84. It should also be appreciated that once the tool holder 60 is broken, the first arm 62 and second arm 66 remain secured to the mounting arms 54 of the rotor 48 and pivotally rotate relative thereto.

Figure 7:
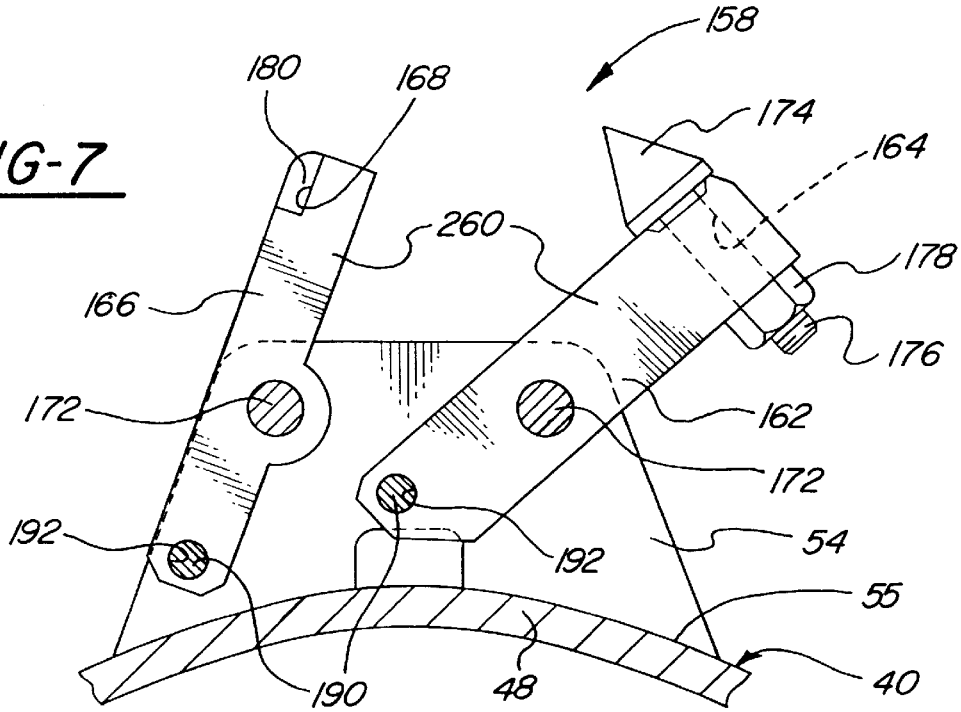
FIG. 7 is an elevational view of another embodiment of the break-away processing tool and rotor assembly of FIG. 2.

Referring to FIG. 7, another embodiment 158, according to the present invention, of the break-away processing tool 58 is shown. Like parts of the break-away processing tool 58 have like reference numerals increased by one hundred (100). The break-away processing tool 158 includes a discontinuous tool holder 160 made of a first arm 162 and a second arm 166 secured to the mounting arms 54 by fasteners such as a bolt 172 and nut (not shown). The first arm 162 includes a cutting tool 174 having a shaft 176 which extends through an aperture 164 in the first arm 162. The cutting tool 174 is removably secured to the first arm 162 by a nut 178 threadably engaging the shaft 176. The second arm 166 includes a wear bar 180 disposed in a recess 168 and secured to the second arm 166 by suitable means such as brazing.

The break-away processing tool 158 also includes at least one shear pin 190 attaching the tool holder 160 to the mounting arms 54. Preferably, a first shear pin 190 attaches the first arm 162 to the mounting arms 154 and a second shear pin 190 attaches the second arm 166 to the mounting arms 154. The shear pin 190 is generally cylindrical in shape and extends through apertures 192 in the first arm 162, second arm 166 and mounting arms 54. The shear pin 190 is made of a softer material than the first arm 162, second arm 166, bolts 172 and mounting arms 54.

In operation of the break-away processing tool 158, the cutting tool 174 contacts the waste product 86. If the material 86 is stuck or lodged by the cutting tool 174 in the waste processing machine 10, the first arm 162 will concentrate stress on the shear pin 190 and cause a breakage by shearing the shear pin 190. As such, the first arm 162 will then pivot about the fastener 172 and remain attached to the mounting arms 54 to prevent damage to the rotor assembly 40. It should be appreciated that the operation is similar for the second arm 166.

Figure 8:
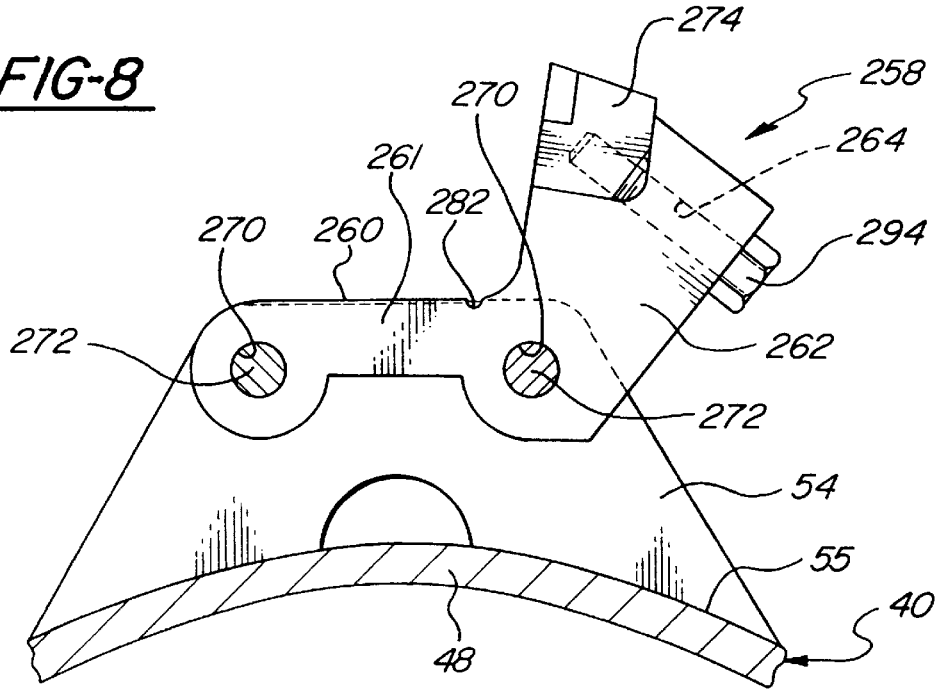
FIG. 8 is an elevational view of yet another embodiment of the break-away processing tool and rotor assembly of FIG. 2.

Referring to FIG. 8, yet another embodiment 258, according to the present invention, of the break-away processing tool 58 is shown. Like parts of the break-away processing tool 58 have like reference numerals increased by two hundred (200). The break-away processing tool 258 includes a tool holder 260 having a body 261 extending circumferentially and an arm 262 extending radially at an angle therefrom with a first aperture 264 extending therethrough. The tool holder 260 includes an aperture 270 at a lower radial end of the arm 262 and another aperture 270 spaced circumferentially therefrom. The body 261 has a width or thickness less than the arm 262. The tool holder 260 is continuous, integral, unitary and made as one-piece. It should be appreciated that the apertures 270 of the tool holder 260 are aligned with the apertures 56 of the mounting arms 54.

The break-away processing tool 258 is retained to the mounting arms 54 by fasteners such as a bolt 272 and nut (not shown). The bolt 272 extends through the apertures 56 in the mounting arms 54 and the apertures 270 in the body 261 of the tool holder 260.

The break-away processing tool 258 also includes a cutting tool 274 attached to the tool holder 260. The break-away processing tool 258 includes a fastener such as a bolt 294 extending through an aperture 264 in the arm 262 and threadably engaging the cutting tool 274. The break-away processing tool 258 further includes a notch 282 in the body 261 of the tool holder 260 adjacent to the arm 262 between the bolts 272 on a radial outer side thereof. The notch 282 extends axially across the body 261 of the tool holder 260. The notch 282 is generally arcuate in shape and has a depth of approximately one quarter inches (0.25 inches). The position, shape and depth of the notch 282 is varied to control breakage of the tool holder 260.

In operation of the break-away processing tool 258, the cutting tool 274 contacts waste product 86. If the waste product 86 is stuck or lodged by the cutting tool 274 in the waste processing machine 10, the arm 262 will concentrate stress on the tool holder 260 in the notch 282 adjacent to the arm 262 and cause a breakage by propagating a crack from the notch 282 radially across the body 261 of the tool holder 260. As such, the arm 262 will then pivot about the bolt 272 which acts as a first pivot pin and remain attached to the mounting arms 54 to prevent damage to the rotor assembly 40. It should be appreciated that the body 261 of the tool holder 260 pivots about the other bolt 272 which acts as a second pivot pin and remains attached to the mounting arm 54 to prevent damage to the rotor assembly 40.

Figure 9:
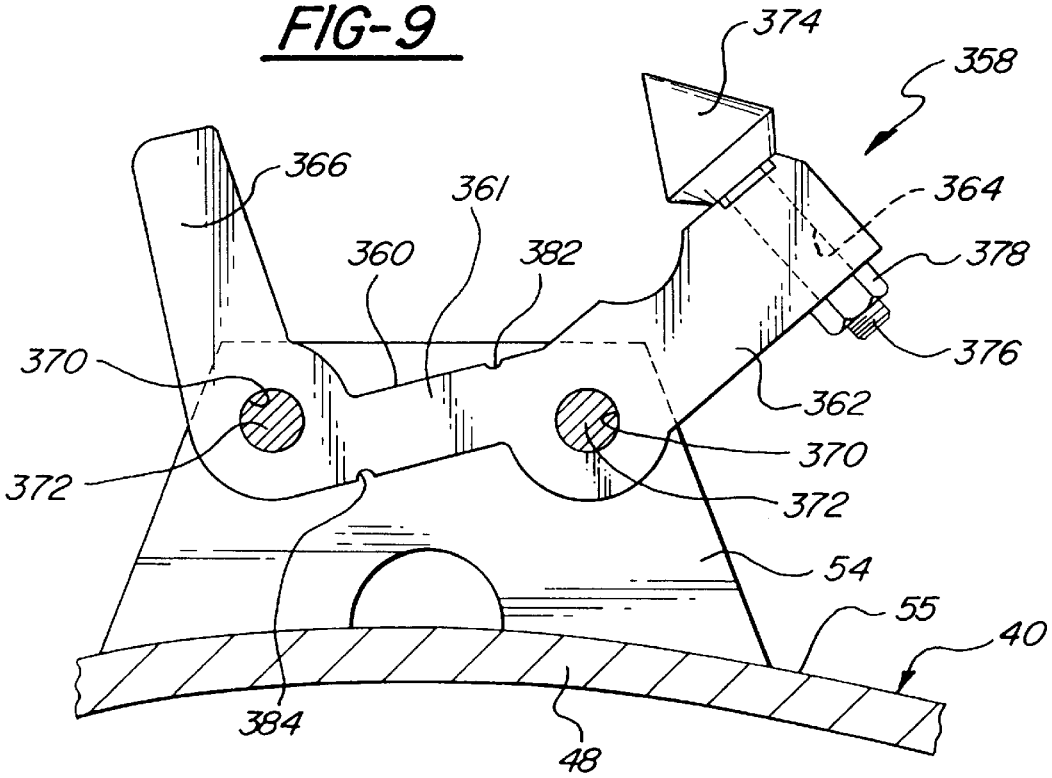
FIG. 9 is an elevational view of still another embodiment of the break-away processing tool and rotor assembly of FIG. 2.

Referring to FIG. 9, still another embodiment 358, according to the present invention, of the break-away processing tool 58 is shown. Like parts of the break-away processing tool 58 have like reference numerals increased by three hundred (300). The break-away processing tool 358 includes a tool holder 360 having a body 361 extending circumferentially and a first arm 362 extending radially at an angle therefrom with a first aperture 364 extending therethrough. The tool holder 360 includes a second arm 366 extending radially along a radian from the longitudinal axis of the rotor 48. The tool holder 360 includes an aperture 370 at a lower radial end of the first arm 362 and second arm 366 and extending axially therethrough. The body 361 has a width or thickness less than the first arm 362 and second arm 366. The tool holder 360 is continuous, integral, unitary and formed as one-piece. It should be appreciated that the alignment of the second arm 366 along a radian of the rotor 48 negates the need for a wear bar. It should also be appreciated that the apertures 370 of the tool holder 360 are aligned with the apertures 56 of the mounting arms 54.

The break-away processing tool 358 is retained to the mounting arms 54 by fasteners such as a bolt 372 and nut (not shown). The bolt 372 extends through the apertures 56 in the mounting arms 54 and the apertures 370 in the body 361 of the tool holder 360.

The break-away processing tool 358 also includes a cutting tool 374 attached to the tool holder 360. The cutting tool 374 is a carbide member having a shaft 376 extending through an aperture 364 in the first arm 362 and removably secured thereto by a nut 378 threadably engaging the shaft 376. The break-away processing tool 358 further includes a first notch 382 in the body 361 of the tool holder 360 adjacent to the first arm 362 between the first arm 362 and second arm 366 on a radial outer side thereof and a second notch 384 in the body 361 adjacent to the second arm 366 between the first arm 362 and second arm 366 on a radial inner side thereof. The notches 382, 384 extend axially across the body 361 of the tool holder 360. The notches 382, 384 are generally arcuate in shape and have a depth of approximately one quarter inches (0.25 inches). The position, shape and depth of the notches 382, 384 are varied to control breakage of the tool holder 360 relative to either the first arm 362 or second arm 366 of the tool holder 360. Operation of the break-away processing tool 358 is similar to the break-away processing tool 58.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A break-away processing tool for a waste processing machine comprising:

a tool holder;

a plurality of fasteners for attaching said tool holder to a rotor assembly of the waste processing machine; and notch means for allowing breakage of said tool holder in a controlled manner as a result of stress on said tool holder and causing the breakage by propagating a crack such that broken pieces of said tool holder remain attached to the rotor assembly by said fasteners.

2. A break-away processing tool as set forth in claim 1 wherein said notch means comprises a notch in said tool holder.

3. A break-away processing tool as set forth in claim 1 wherein said tool holder has at least one arm extending radially therefrom.

4. A break-away processing tool for a waste processing machine comprising:

a tool holder;

at least one fastener for attaching said tool holder to a rotor assembly of the waste processing machine; and notch means for allowing breakage of said tool holder in a controlled manner as a result of stress on said tool holder and causing the breakage by propagating a crack such that broken pieces of said tool holder remain attached to the rotor assembly by said at least one fastener;

wherein said tool holder has at least one arm extending radially therefrom;

wherein said tool holder has an aperture at a lower end of said at least one arm and extending axially therethrough, said at least one fastener extending axially through said at least one aperture.

5. A break-away processing tool as set forth in claim 4 wherein said notch means comprises at least one notch extending axially across said tool holder.

6. A break-away processing tool as set forth in claim 5 wherein said at least one notch is disposed adjacent said at least one arm on a radial outer side of said tool holder.

7. A break-away processing tool as set forth in claim 5 wherein said at least one notch is disposed adjacent said at least one arm on a radial inner side of said tool holder.

8. A break-away processing tool for a waste processing machine comprising:

a tool holder;

at least one fastener for attaching said tool holder to a rotor assembly of the waste processing machine; and notch means for allowing breakage of said tool holder in a controlled manner as a result of stress on said tool holder and causing the breakage by propagating a crack such that broken pieces of said tool holder remain attached to the rotor assembly by said at least one fastener;

wherein said tool holder has at least one arm extending radially therefrom;

wherein said tool holder has a plurality of apertures extending axially therethrough, said at least one fastener extending axially through each of said apertures.

9. A break-away processing tool as set forth in claim 8 wherein said notch means comprises at least one notch extending axially across said tool holder and located between a pair of said apertures.

10. A break-away processing tool as set forth in claim 8 including a first arm extending radially from said tool holder and a second arm extending radially from said tool holder and spaced from said first arm.

11. A break-away processing tool as set forth in claim 10 wherein said notch means comprises a pair of notches extending axially across said tool holder, one of said notches being disposed adjacent said first arm on a radial outer side of said tool holder and another of said notches being disposed adjacent said second arm on a radial inner side of said tool holder.

12. A break-away processing tool as set forth in claim 11 including a cutting tool attached to said first arm.

13. A break-away processing tool as set forth in claim 11 including a wear bar attached to said second arm.

14. A break-away processing tool as set forth in claim 10 wherein said second arm extends along a radian of the rotor assembly.

15. A break-away processing tool for a waste processing machine comprising:

a tool holder;

a plurality of fasteners for attaching said tool holder to a rotor assembly of the waste processing machine; and at least one notch in said tool holder for allowing breakage of said tool holder in a controlled manner as a result of stress on said tool holder in said at least one notch and causing the breakage by propagating a crack such that broken pieces of said tool holder remain attached to the rotor assembly by said fasteners.

16. A break-away processing tool as set forth in claim 15 wherein said tool holder has at least one arm extending radially therefrom.

17. A break-away processing tool for a waste processing machine comprising:

a tool holder;

at least one fastener for attaching said tool holder to a rotor assembly of the waste processing machine; and at least one notch in said tool holder for allowing breakage of said tool holder in a controlled manner as a result of stress on said tool holder in said at least one notch and causing the breakage by propagating a crack such that broken pieces of said tool holder remain attached to the rotor assembly by said at least one fastener;

wherein said tool holder has at least one arm extending radially therefrom;

wherein said tool holder has a plurality of apertures extending axially therethrough, said at least one fastener extending axially through each of said apertures.

18. A break-away processing tool for a waste processing machine comprising:

a tool holder;

at least one fastener for attaching said tool holder to a rotor assembly of the waste processing machine; and at least one notch in said tool holder for allowing breakage of said tool holder in a controlled manner as a result of stress on said tool holder in said at least one notch and causing the breakage by propagating a crack such that broken pieces of said tool holder remain attached to the rotor assembly by said at least one fastener;

a first arm extending radially from said tool holder and a second arm extending radially from said tool holder and spaced from said first arm.

19. A break-away processing tool as set forth in claim 18 including a pair of notches extending axially across said tool holder, one of said notches being disposed adjacent said first arm on a radial outer side of said tool holder and another of said notches being disposed adjacent said second arm on a radial inner side of said tool holder.

20. A break-away processing tool for a waste processing machine comprising:

a tool holder;

a plurality of fasteners for pivotally attaching said tool holder to a rotor assembly of the waste processing machine;

a first arm extending radially from said tool holder and a second arm extending radially from said tool holder and spaced from said first arm;

a pair of notches extending axially across said tool holder, one of said notches being disposed adjacent said first arm on a radial outer side of said tool holder and another of said notches being disposed adjacent said second arm on a radial inner side of said tool holder, said notches allow breakage of said tool holder in a controlled manner and causing the breakage by propagating a crack such that said first arm and said second arm remain attached to the rotor assembly;

a cutting tool attached to said first arm; and a wear bar attached to said second arm.

* * * * *

UNITED STATES PATENT AND TRADEMARK OFFICE

CERTIFICATE OF CORRECTION

PATENT NO. : 6,047,912
DATED : April 11, 2000
INVENTOR(S) : Leward N. Smith

It is certified that error appears in the above-identified patent and that said Letters Patent is hereby corrected as shown below:

Drawings,
Figure 7, reference numeral "260" should read -- 160 --.

Signed and Sealed this

Fourth Day of November, 2003

JAMES E. ROGAN
*Director of the United States Patent and Trademark Office*